US005722090A

United States Patent [19]

Hughes

[11] Patent Number: 5,722,090

[45] Date of Patent: Mar. 3, 1998

[54] BACK-REINFORCED TWO-PIECE UPPER TORSO ASSEMBLY FOR ARTICULATED ONE-ATMOSPHERE DIVING SUIT

[75] Inventor: Robert J. Hughes, Lynn Haven, Fla.

[73] Assignee: The United States of America as represented by the Secretary of the Navy, Washington, D.C.

[21] Appl. No.: 679,839

[22] Filed: Jul. 15, 1996

[51] Int. Cl.[6] ..... B63C 11/02

[52] U.S. Cl. ..... 2/2.17; 2/2.15

[58] Field of Search ..... 2/2.11, 2.12, 2.13, 2/2.15, 2.17; 285/276, 367, 330, 364, 365, 379

[56] References Cited

U.S. PATENT DOCUMENTS

| | | | |
|---|---|---|---|
| 1,307,921 | 6/1919 | Niehoff | 2/2.15 |
| 2,034,637 | 3/1936 | Mooney | 2/2.15 |
| 2,626,602 | 1/1953 | Buie | 2/2.15 |
| 3,127,616 | 4/1964 | Schueller | 2/2.15 |
| 3,574,862 | 4/1971 | Jones | 2/2.15 |
| 4,034,416 | 7/1977 | Buffkin et al. | 2/2.15 |

FOREIGN PATENT DOCUMENTS

| | | | |
|---|---|---|---|
| 489750 | 8/1938 | United Kingdom | 2/2.15 |

*Primary Examiner*—C. D. Crowder
*Assistant Examiner*—Larry D. Worrell, Jr.
*Attorney, Agent, or Firm*—Harvey A. Gilbert; William C. Townsend

[57] ABSTRACT

A back-reinforced two-piece upper torso assembly for an articulated diving suit. The upper torso assembly includes a lower hollow rigid body of rounded shape for housing a diver's upper trunk, an upper hollow rigid body of rounded shape for housing a diver's head and being seated upon the lower hollow rigid body, and a clamping and sealing mechanism releasably coupling the upper hollow rigid body to the lower hollow rigid body about adjacent seated portions thereof so as to form a watertight joint therebetween wherein the upper hollow rigid body can rotate relative to the lower hollow rigid body. The upper torso assembly also includes a reinforcement structure connecting the upper hollow rigid body to the lower hollow rigid body along adjacent rear portions thereof so as to permit a lifting load applied to the assembly during water entry and exit to transfer to the lower hollow rigid body in such manner as to avoid stressing the watertight joint therebetween.

16 Claims, 2 Drawing Sheets

BACK-REINFORCED TWO-PIECE UPPER TORSO ASSEMBLY FOR ARTICULATED ONE-ATMOSPHERE DIVING SUIT

BACKGROUND OF THE INVENTION

1. Field of the Invention

The present invention generally relates to the field of one-atmosphere diving in articulated jointed submersibles and, more particularly, is concerned with a back-reinforced two-piece upper torso assembly for an articulated one-atmosphere diving suit.

2. Description of the Prior Art

Articulated jointed submersibles resemble an outer exoskeleton that allows a diver to work in the safety and comfort of one atmosphere pressure while the outer water pressure is extremely high. This allows the diver to avoid decompressing from nitrogen uptake in his blood. Because of the anthropomorphic construction of the diving suits, arm and head penetrators need to be placed in certain positions to allow sufficient human mobility.

Existing designs of this type of anthropomorphic diving suits are the NEWT series of suits. The NEWT series of diving suits has an upper torso made up of two joined spherical sections, and a vision dome at the face plate. Joints for arms connect to the lower spherical section near the junction of the sphere. The suit is lifted out of the water via a reinforcement structure referred to as a "strong-back" extending from the top of the suit down to the connection with a lower torso of the suit. The existing suit, because of the size of the design, is made with a cast process, further limiting the structural strength and the consequent diving depth of the suit.

Thus, the existing diving suits are depth limited by the design constraints of the upper torso, which must accommodate entry of as great a variety of human subjects as possible. The upper torso is the main structural piece of these suits. Because of the consequent design of the upper torso based on the above criteria, existing suit manufacturing methods are limited to casting methods that ultimately restrict the depth limitations due to manufacturing variances, poorer quality material, and manufacturing constrictions.

Consequently, a need exists for improvements in the design of an articulated diving suit that will overcome the drawbacks of the prior art without introducing new ones in their place.

SUMMARY OF THE INVENTION

The present invention provides a back-reinforced two-piece upper torso assembly designed to satisfy the aforementioned need. The upper torso assembly of the present invention modifies the structural design of existing one-atmosphere articulated joint diving suits in a manner which increases the depth capability of the suit, reduces the component weight, and eases handling of the suit during water entry and retrieval. The upper torso assembly also improves the ease of manufacturing and repeatability of manufacturing (which is critical for commercial certification of use), allows for use of higher strength materials, and reduces the net cost of manufacturing.

Accordingly, the present invention is directed to an upper torso assembly for an articulated one-atmosphere diving suit. The upper torso assembly comprises a lower hollow body of rounded shape for housing a diver's upper trunk, and an upper hollow body of rounded shape for housing a diver's head. The lower and upper hollow bodies preferably are rigid bodies and spherical in shape. The lower hollow body has a pair of opposite spaced apart upper and lower openings while the upper hollow body has a front face opening and a bottom opening. The upper hollow body is seated upon the lower hollow body at respective portions of the lower and upper hollow bodies surrounding the upper opening of the lower hollow body and the bottom opening of the upper hollow body. The lower hollow body also has a pair of opposite arm holes defined through respective opposite sides thereof.

The upper torso assembly also comprises a clamping and sealing mechanism for releasably coupling together the seated portions of the lower and upper hollow bodies so as to form a watertight joint therebetween wherein the upper hollow body can rotate relative to the lower hollow body. The seated portions of the lower and upper hollow bodies take the form of an annular bottom rim of the upper hollow body and an annular upper rim of the lower hollow body. The clamping and sealing mechanism includes an annular seal ring which seats and seals between the rims and an annular split clamp which surrounds and encloses the rims. The clamping and sealing mechanism does not allow for transference of discontinuity stresses between the upper and lower hollow bodies which thereby avoids creation of problems around arm hole locations.

The upper torso assembly further comprises a back reinforcement mechanism connected with the upper and lower hollow bodies along adjacent rear portions thereof so as to permit a lifting load applied to the assembly during water entry and exit to transfer to the lower hollow body of the assembly in such manner as to avoid stressing the watertight joint between the lower and upper hollow bodies. More particularly, the back reinforcement mechanism includes an upper exterior rib attached on the rear portion of the upper hollow body, a lower exterior rigid rib attached on the rear portion of the lower hollow body, and an elongated rigid connector fastened to the upper and lower exterior rib and having means for attaching a lift line to the connector.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
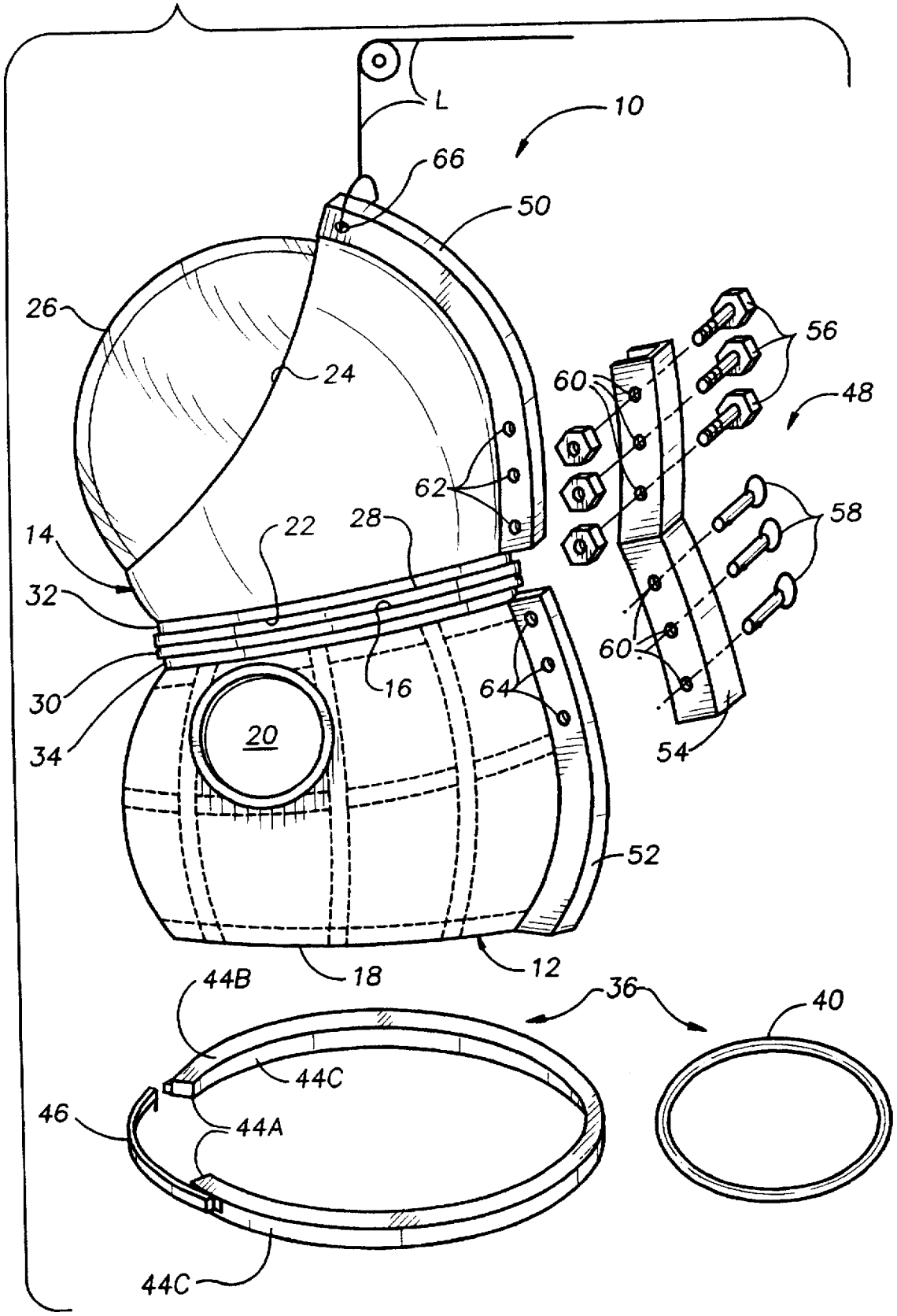
FIG. 1 is a perspective view of a back-reinforced two-piece upper torso assembly shown in semi-assembled form.
Figure 2:
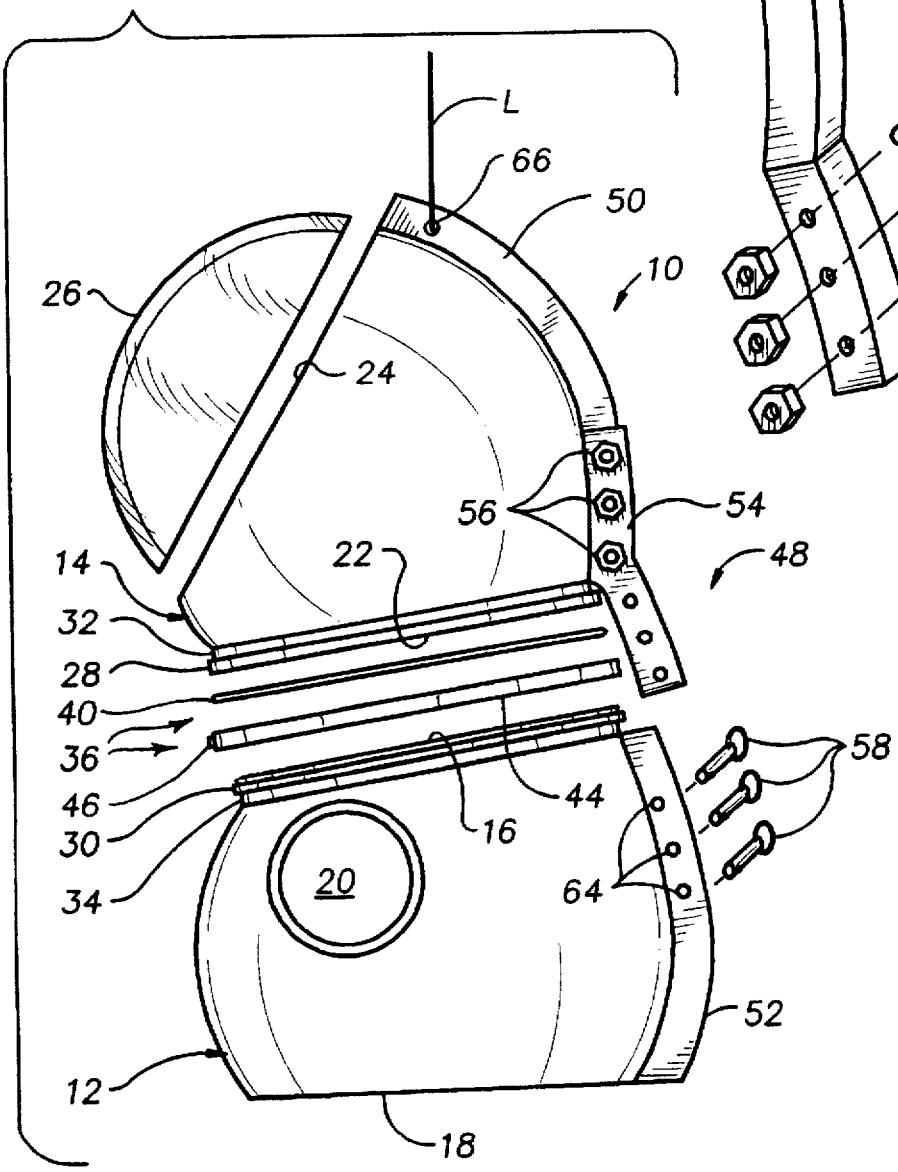
FIG. 2 is an exploded side elevational view of upper and lower hollow bodies, a clamping and sealing mechanism and a back reinforcement mechanism of the upper torso assembly.

Referring to the drawings and particularly to FIGS. 1 and 2, there is illustrated a back-reinforced two-piece upper torso assembly, generally designated 10, of the present invention.

The upper torso assembly 10 is particularly suitable, although not so limited, for use in conjunction with an articulated one-atmosphere diving suit. Since the one side of the upper torso assembly 10 shown in FIGS. 1 and 2 is identical to the opposite side thereof, a person of ordinary skill in this art can readily gain a clear understanding of the construction of the assembly 10 from the description set forth hereinafter with reference to only the one side of the upper torso assembly 10 shown in the drawings.

Basically, the upper torso assembly 10 includes a lower hollow shell-like body 12 of rounded shape for housing a diver's upper trunk and an upper hollow shell-like body 14 of rounded shape for housing a diver's upper trunk and adapted to seat upon the lower hollow body 12. The lower and upper hollow bodies 12, 14 preferably are rigid bodies and substantially spherical in shape. The lower hollow body 12 has a pair of opposite spaced apart upper and lower circular openings 16, 18 and a pair of opposite arm holes 20 formed through respective opposite sides thereof. The upper hollow body 14 has a bottom circular opening 22 and a front upper circular face opening 24 for receiving and fitting a vision dome 26 on the upper hollow body 14. The upper hollow body 14 seats upon the lower hollow body 12 at respective adjacent portions thereof surrounding the upper opening 16 of the lower hollow body 12 and the bottom opening 22 of the upper hollow body 14.

The seated portions of the lower and upper hollow bodies 12, 14 take the form of a bottom annular rim 28 integrally form on the upper hollow body 14 surrounding the bottom opening 22 thereof and an upper annular rim 30 integrally formed on the lower hollow body 12 surrounding the upper opening 16 thereof. The bottom rim 28 defines a bottom annular groove 32 on the upper hollow body 14 along a side of the bottom rim 28 opposite from the bottom opening 22 of the upper hollow body 14. The upper rim 30 on the lower hollow body 12 defines an upper annular groove 34 on the lower hollow body 12 along a side of the upper rim 30 opposite from the upper opening 16 of the lower hollow body 12.

Figure 3:
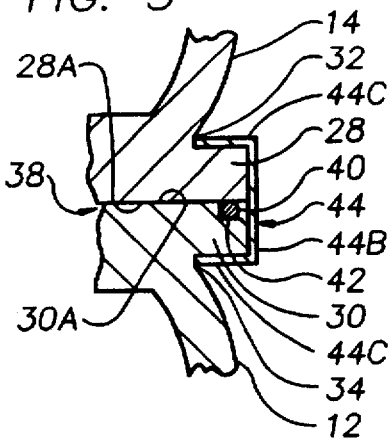
FIG. 3 is an enlarged fragmentary cross-sectional view of the clamping and sealing arrangement between upper and lower hollow bodies of the upper torso assembly.

Referring to FIGS. 1–3, the upper torso assembly 10 also includes a clamping and sealing mechanism, being generally designated 36, for releasably coupling to one another the respective seated portions, or bottom and upper rims 28, 30 of the lower and upper hollow bodies 12, 14 to form a watertight joint therebetween, being generally designated 38, wherein the upper hollow body 14 can rotate upon and relative to the lower hollow body 12. More particularly, the sealing and clamping mechanism 36 includes an annular seal ring 40 of a flexible resilient compressible material, such as a conventional rubber O-ring, disposed between the bottom rim 28 of the upper hollow body 14 and the upper rim 30 of the lower hollow body 12. The seal ring 40 preferably is seated in an annular channel 42 formed in the top surface 30A of the upper rim 30 on the lower hollow body 12 and protrudes upwardly from the channel 42 sufficiently to contact and seal against the bottom surface 28A of the lower rim 28 on the upper hollow body 12 when the bottom and upper rims 28, 30 are clamped together.

Futher, the clamping and sealing mechanism 36 includes an annular split clamp 44, such as a marmen clamp device, having a pair of opposite ends 44A and being U-shaped in cross-section. The clamp 44 is sized and shaped at its back wall 44B and opposing side flanges 44C to surround the outer peripheries of the bottom and upper rims 28, 30 and to extend into the bottom groove 32 on the upper hollow body 14 and the upper groove 34 on the lower hollow body 12 and thereby enclose the bottom and upper rims 28, 30. The clamping and sealing mechanism 36 also includes fastening means 46, such as a pivotal latch or the like, interconnecting the opposite ends 44A of the clamp 44 and being movable to a closed position so as to tighten the clamp 44 and thereby, because of the distances set between the bottom and upper grooves 32, 34, exert a slight compressive load between the bottom and upper rims 28, 30 which compresses the annular seal ring 40 and produces the sealed watertight joint 38 between the bottom and upper rims 28, 30 of the upper and lower hollow bodies 14, 12 allowing no leakage to occur through the joint 38. The marmen clamp could be replaced with a locking bayonet device for additional clamping force, if desired. Also, the clamp could be applied on the interior, if desired. The slight compressive load permits rotation of the bottom rim 28 and the upper hollow body 14 relative to the upper rim 30 and the lower hollow body 12. The above-described clamping and sealing mechanism 36 does not allow for transference of discontinuity stresses between the upper and lower hollow bodies 14, 12 which thereby avoids creation of problems around arm hole locations. From the above description of the embodiment of the upper torso assembly shown in FIGS. 1 to 4, it can be observed and understood that the annular seal ring 40 and split clamp 44 are components that are separate from one another and from the lower and upper hollow bodies 12, 14 and that the ring 40 and clamp 44 engage and releasably couple the upper hollow body 14 to the lower hollow body 12 solely about their respective annular bottom and upper rims 28, 30 in forming the watertight joint 38.

With the above-described upper torso assembly 10 incorporated into a diving suit, the upper hollow body 14 covers the diver's head and allows the diver to see out of the diving suit through the vision dome 26 and to move his or her head from side to side with the rotation of the upper hollow body 14 relative to the lower hollow body 12. Also, the lower hollow body 12 covers the diver's upper body and allows the diver to extend his or her arms out of the arm holes 20 which are provided in the correct ergonomic position relative to the diver's position in the suit.

The lower and upper hollow bodies 12, 14 are made of a suitable material, preferably aluminum. Each body 12, 14 can be machined from a forged billet of material with the correct relation of stiffness, strength, and weight relative to the maximum depth limit. The ability to machine the larger lower hollow body 12 is enhanced by the ability of a computerized machine tool to access both the top and bottom of the body 12. Each of the bodies 12, 14 maintains near sphericity, which is inherently stronger and more resistant to crushing compared to non-spherical shapes. This sphericity can be maintained because the suit is computer numerical machined from a pre-forged billet of material whose grain structure is oriented close to the final direction of the shell. Also, inspection of the diving suit for certifiability to depth limits is enhanced because of inherent sphericity which allows for easier computerized (or hand) inspections.

For facilitating application of a lifting load to the upper torso assembly 10 to enable entry of the diving suit into and exit thereof from water, the upper torso assembly 10 further includes a back stiffener or reinforcement mechanism, generally designated 48, for connecting with the lower and upper hollow bodies 12, 14 along adjacent rear portions thereof. The reinforcement mechanism 48 includes an upper exterior rib 50 attached on the rear portion of the upper hollow body 14, a lower exterior rigid rib 52 attached on the rear portion of the lower hollow body 12, and an elongated rigid connector 54 fastened to the upper and lower ribs 50, 52 by bolts 56 and releasable pins 58 extended through apertures 60 in the connector 54 and through holes 62, 64 in the upper and lower ribs 50, 52 aligned with the connector apertures 58. The upper rib 50 also has a hole 66 for attaching a lift line L thereto. The use of the releasable pins 58 and the clamp 44 permits the upper hollow body 14 to be quickly removed, in the event it is necessary to do so, from the lower hollow body 12.

Figure 4:
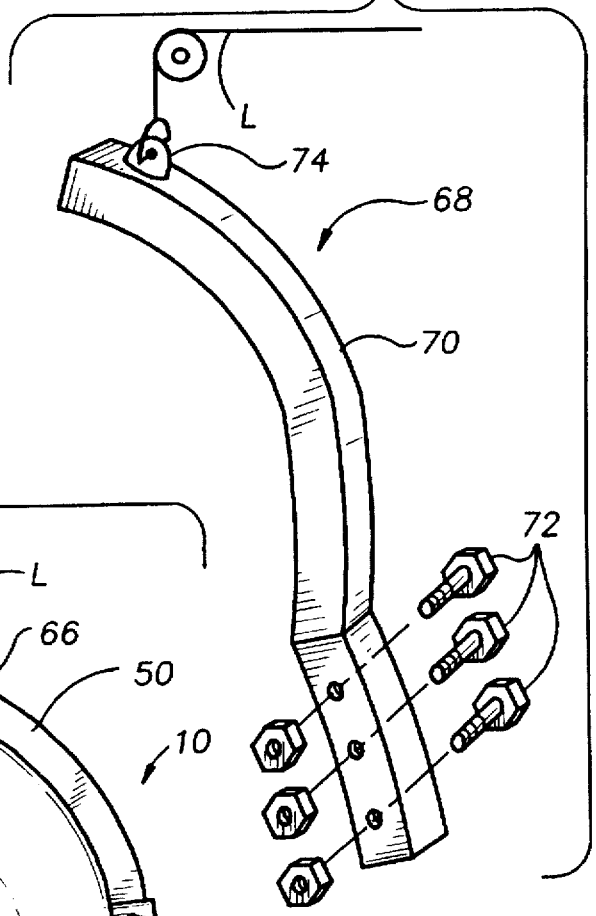
FIG. 4 is a perspective view of an alternative back reinforcement mechanism.

As an alternative embodiment, FIG. 4 shows another back reinforcement mechanism 68 having a connector 70 which can be connected solely to the lower hollow body 12 by bolts 72 so as to enable lifting of the diving suit without contacting the upper hollow body 14. The lift line L is then attached at eyelet 74 on the upper end of the connector 70.

The connection of the reinforcement mechanism 48 with the lower and upper hollow bodies 12, 14 permits the lifting load applied to the assembly 10 during water entry and exit to transfer to the lower hollow body 12 in such manner as to avoid stressing the watertight joint 38. Additional ribs can be provided in the bodies 12, 14 to act as structural stiffeners to extend the depth capability. These ribs can be readily machined by the CNC process used to make the entire assembly 10. The above-described reinforcement mechanism 48 also permits the use of the relatively small marmen type clamp 44 which is only required to carry enough preload to prevent leakage of sea water through the watertight joint 38.

In summary, the above-described design of the upper torso assembly 10 of the present invention achieves the following advantages and improvements over existing designs: (1) provides a means of increasing depth limitations of anthropomorphically configured diving suits; (2) permits the use of improved manufacturing methods that allows for better control of critical tolerances in the manufacturing of manned underwater pressure vessels; (3) allows for more cost efficient construction of anthromorphically configured manned pressure vessels; (4) permits easier certifiability of the design to current commercial practices because of ease of verification of manufacturing dimensions; (5) provides a suit where the diver's head can be exposed during pre-diving operations; and (6) provides for connection of the lower and upper hollow bodies 12, 14 of the suit in a manner that allows freedom of relative motion therebetween to minimize discontinuity stresses while maintaining a watertight seal between the hollow bodies during launching and retrieval of the suit from the water.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An upper torso assembly for an articulated diving suit, said assembly comprising:

(a) a lower hollow body of substantially spherical rigid shape for housing a diver's upper trunk, said lower hollow body having opposite spaced apart upper and lower openings;

(b) an upper hollow body of substantially spherical rigid shape for housing a diver's head, said upper hollow body having a front face opening and a bottom opening and being seated upon said lower hollow body at adjacent portions of said lower and upper hollow bodies respectively surrounding said upper opening of said lower hollow body and said bottom opening of said upper hollow body, said seated portion of said upper hollow body being an annular bottom rim integrally formed on said upper body and surrounding said bottom opening thereof, said seated portion of said lower hollow body being an annular upper rim integrally-formed on said lower hollow body and surrounding said upper opening thereof; and (c) a clamping and sealing mechanism including an annular seal ring and an annular split clamp being separate from and non-attached to one another and separate from sand non-attached to said lower and upper hollow bodies except for solely releasably coupling said upper hollow body to said lower hollow body about said respective annular bottom and top rims thereof so as to form a watertight joint therebetween wherein said upper hollow body can rotate relative to said lower hollow body.

2. The assembly of claim 1 wherein said lower hollow body has a pair of opposite arm holes defined through respective opposite sides thereof.

3. The assembly of claim 1 wherein said annular seal ring is made of resilient compressible material disposed between said bottom rim of said upper hollow body and said upper rim of said lower hollow body.

4. The assembly of claim 1 wherein:

said bottom rim of said upper hollow body defines a bottom annular groove on said upper hollow body along a side of said bottom rim opposite from said bottom opening of said upper hollow body; and said upper rim of said lower hollow body defines an upper annular groove on said lower hollow body along a side of said upper rim opposite from said upper opening of said lower hollow body.

5. The assembly of claim 4, wherein said annular split clamp has a pair of opposite ends and is U-shaped in cross-section so as to surround outer peripheries of said lower and upper rims and extend into said bottom groove on said upper hollow body and said upper groove on said lower hollow body and thereby enclose said lower and upper rims.

6. The assembly of claim 5 wherein said sealing and clamping mechanism further includes fastening means for interconnecting said opposite ends of said clamp so as to exert a slight compressive load between said lower and upper rims.

7. An upper torso assembly for an articulated diving suit, said assembly comprising:

(a) a lower hollow body of rounded shape for housing diver's upper trunk;

(b) an upper hollow body of rounded shape for housing a diver's head; and (c) means for seating said upper hollow body upon, and releasably coupling said upper hollow body to, said lower hollow body so as to form a watertight Joint therebetween; and (d) a back reinforcement mechanism connected to at least said lower hollow body along a rear portion thereof adjacent to said upper hollow body so as to permit a lifting load applied to said assembly during water entry and exit to transfer to said lower hollow body in a manner which avoids stressing said watertight joint between said upper and lower hollow bodies;

(e) said back reinforcement mechanism including (i) a lower exterior rigid rib attached on said rear portion of said lower hollow body, (ii) an elongated rigid connector fastened to said lower exterior rib, and (iii) means for attaching a lift line to reinforcement mechanism.

8. The assembly of claim 7 wherein said lower and upper hollow bodies are rigid bodies and are substantially spherical in shape.

9. The assembly of claim 7 wherein said lower hollow body has a pair of opposite arm holes defined through respective opposite sides thereof.

10. The assembly of claim 7 wherein said back reinforcement mechanism further includes an upper exterior rib attached on said rear portion of said upper hollow body, said connector also being fastened to said upper exterior rib.

11. An upper torso assembly for an articulated diving suit, said assembly comprising:

(a) a lower rigid hollow body of spherical shape for housing a diver's upper trunk, said lower hollow body having opposite spaced apart upper and lower openings;

(b) an upper rigid hollow body of spherical shape for housing a diver's head, said upper hollow body having a front face opening and a bottom opening and being seated upon said lower hollow body at adjacent portions of said lower and upper hollow bodies respectively surrounding said upper opening of said lower hollow body and said bottom opening of said upper hollow body;

(c) a clamping and sealing mechanism releasably coupling said upper hollow body to said lower hollow body about said adjacent seated portions thereof so as to form a watertight joint therebetween wherein said upper hollow body can rotate relative to said lower hollow body; and (d) a back reinforcement mechanism connecting said upper hollow body to said lower hollow body along adjacent rear portions thereof so as to permit a lifting load applied to said assembly during water entry and exit to transfer to said lower hollow body in such manner as to avoid stressing said watertight joint between said upper and lower hollow bodies.

12. The assembly of claim 11 wherein said lower hollow body has a pair of opposite arm holes defined through respective opposite sides thereof.

13. The assembly of claim 11 wherein:

said seated portion of said upper hollow body is an annular bottom rim defining a bottom annular groove on said upper hollow body along a side of said bottom rim opposite from said bottom opening of said upper hollow body; and said seated portion of said lower hollow body is an annular upper rim defining an upper annular groove on said lower hollow body along a side of said upper rim opposite from said upper opening of said lower hollow body.

14. The assembly of claim 13 wherein said sealing and clamping mechanism includes an annular seal ring of resilient compressible material disposed between said bottom rim of said upper hollow body and said upper rim of said lower hollow body.

15. The assembly of claim 13 wherein said sealing and clamping mechanism includes:

an annular split clamp having a pair of opposite ends and being U-shaped in cross-section so as to surround outer peripheries of said lower and upper rims and to extend into said bottom groove on said upper hollow body and said upper groove on said lower hollow body and thereby enclose said lower and upper rims; and fastening means for interconnecting said opposite ends of said clamp so as to exert a slight compressive load between said lower and upper rims.

16. The assembly of claim 11 wherein said back reinforcement mechanism includes:

an upper exterior rib attached on said rear portion of said upper hollow body;

a lower exterior rigid rib attached on said rear portion of said lower hollow body;

an elongated rigid connector fastened to said upper and lower exterior rib; and means for attaching a lift line to one of said connector and said upper rib.

* * * * *